US005249490A

United States Patent [19]

Kennel

[11] Patent Number: 5,249,490

[45] Date of Patent: Oct. 5, 1993

[54] ADJUSTABLE HEXAGONAL WRENCH

[76] Inventor: George W. Kennel, 13 Garretson Rd., White Plains, N.Y. 10604

[21] Appl. No.: 930,808

[22] Filed: Aug. 17, 1992

[51] Int. Cl.[5] ..... B25B 7/04

[52] U.S. Cl. ..... 81/405; 81/90.3; 81/128; 81/352; 81/362

[58] Field of Search ..... 81/342, 345, 347, 352-355, 81/362, 363, 383, 383.5, 405, 90.2, 90.3, 91.2, 91.3, 128

[56] References Cited

U.S. PATENT DOCUMENTS

| | | | |
|---|---|---|---|
| 319,017 | 6/1885 | Payne | 81/352 |
| 681,160 | 8/1901 | Weibezahn | 81/352 |
| 2,096,016 | 10/1937 | Weishampel | 81/362 |
| 2,547,534 | 4/1951 | Oliver | 81/383 |
| 2,687,661 | 8/1954 | Richardson | 81/352 |
| 2,787,925 | 4/1957 | Buchanan et al. | 81/342 |
| 3,031,001 | 4/1962 | Stoltz | 81/362 |
| 3,166,960 | 1/1965 | Roessler | 81/355 |

FOREIGN PATENT DOCUMENTS

| | | | |
|---|---|---|---|
| 1173016 | 6/1964 | Fed. Rep. of Germany | 81/405 |

*Primary Examiner*—James G. Smith
*Attorney, Agent, or Firm*—H. M. Snyder

[57] ABSTRACT

An adjustable wrench having a pair of spring-biased pivoted handles and a plurality of jaw members having fastener-contacting faces actuable by squeezing motion of the handles to close upon a range of sizes of hexagonal fastener members.

5 Claims, 1 Drawing Sheet

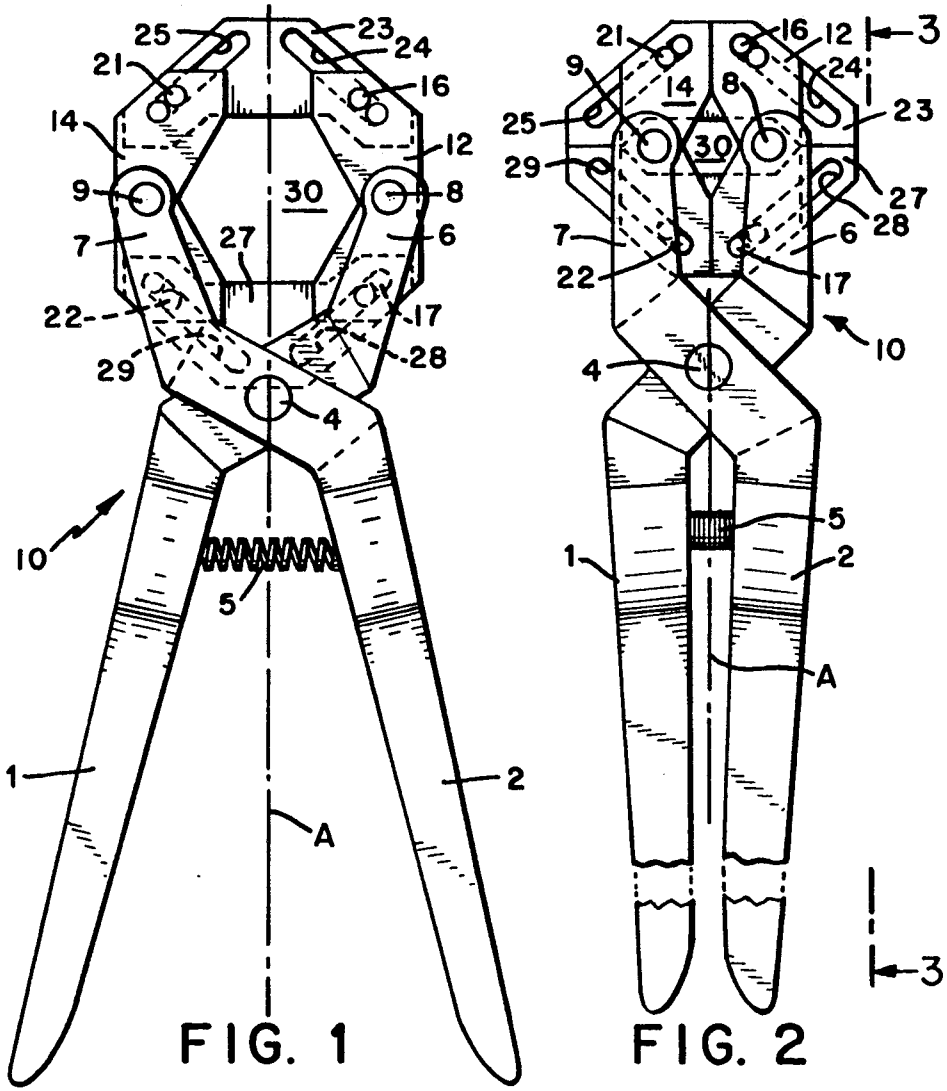
FIG. 1
FIG. 2
3
3
A
A
1
2
4
5
6
7
8
9
10
12
14
16
17
21
22
23
24
25
27
28
29
30
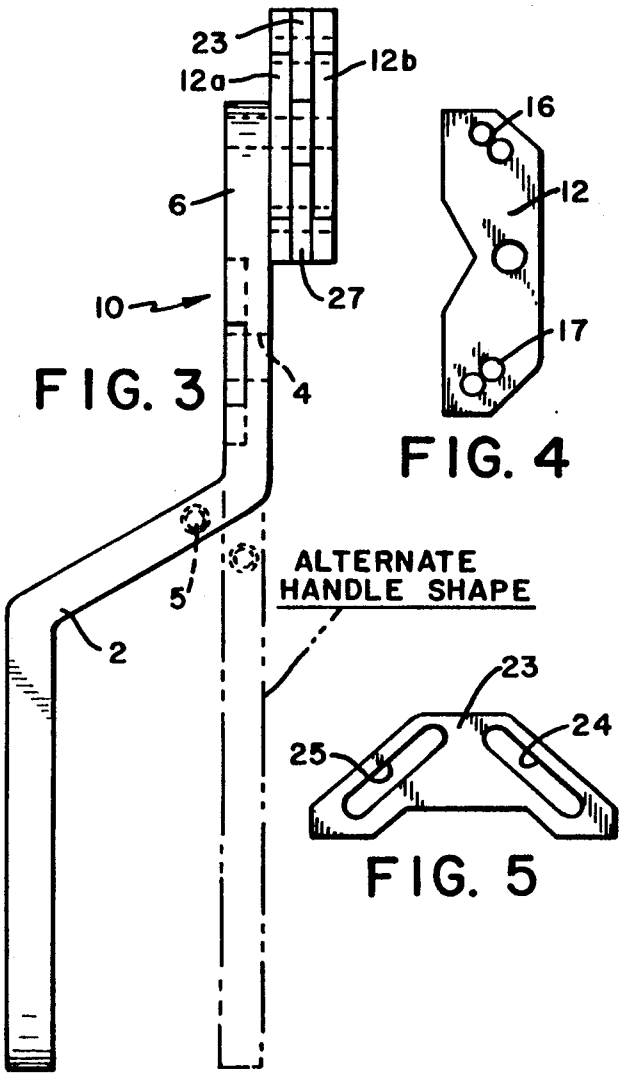
FIG. 3
FIG. 4
FIG. 5
ALTERNATE HANDLE SHAPE
1
2
4
5
5'
6
10
12
12a
12b
16
17
23
24
25
27

ADJUSTABLE HEXAGONAL WRENCH

FIELD OF THE INVENTION

The invention is directed to an improved structure for a self-adjusting wrench capable of handling a range of sizes of hexagonal bolts or nuts.

BACKGROUND OF THE INVENTION

It is common to employ open end and box wrenches, or wrenches having one adjustable jaw member to grip hexagonal bolts or nuts. In the case of open end and box wrenches, they make good contact with the several flats of hexagonal bolts or nuts, but a different size wrench is required for each size of fastener. The adjustable wrenches have disadvantages in that they generally engage only two of the hexagonal bolt/nut flats and, consequently, are subject to slippage about the fastener, they generally require carefully machined screw-type driving surfaces and must be reversed as between fastening and unfastening operations.

SUMMARY OF THE INVENTION

The disadvantages of the prior art wrenches are overcome in the present invention by providing a wrench which is adjustable to accommodate a range of sizes of hexagonal bolts or nuts and engages all six corners and flats of the fasteners thereby being operative for both fastening and unfastening once positioned. The wrench is provided with pivoted handles which are squeezed together to actuate a plurality of jaw elements which close upon the hexagonal bolts or nuts contacting all six faces of those members.

In more detail, each handle element terminates in an actuating arm portion and the actuating arm portions are moved toward each other as the handle members are squeezed and rotate about the pivot. Each actuating arm is connected to drive lateral jaw members toward a central position. The lateral jaw members associated with each actuating arm are comprised of paired, spaced jaw elements which are joined by a pair of drive pins. The lateral jaw members together cooperate to conform to four faces of a hexagonal bolt or nut as they are driven toward a central position.

Between the paired, spaced jaw elements, upper and lower jaw members are installed and arranged to move toward a central position. The upper and lower jaw members are each provided with a pair of angled slots through which the drive pins joining the paired, spaced lateral jaw elements extend. The upper and lower jaw members are each shaped to provide a surface for contacting one face of an hexagonal bolt or nut.

As the adjustable wrench is placed about a hexagonal bolt or nut and the handle is squeezed, the actuating pins force the lateral jaw members toward a central position, the drive pins secured to the lateral jaw members ride in the slots of the upper and lower jaw members, moving the upper and lower jaw members toward a central position. The net effect of the coordinated movement of the jaw members toward a central position is to close tightly upon the hexagonal nut or bolt lying within the jaw members ready for fastening or unfastening operation.

DESCRIPTION OF THE DRAWINGS

FIG. 1 is a plan view of the adjustable wrench of the invention in the open position;

FIG. 2 is a view similar to FIG. 1 with the wrench in the closed position;

FIG. 3 is a side view of the wrench with a dotted line showing of an alternate handle shape;

FIG. 4 is a plan view of a lateral jaw element used in the present invention; and FIG. 5 is a plan view of an upper or lower jaw member used in the present invention.

DETAILED DESCRIPTION OF THE INVENTION

In FIG. 1 the adjustable wrench 10 is shown in normally open position having handle members 1 and 2 pivoted at 4 and biased to the open position by spring 5. The handle members 1 and 2 extend beyond the pivot to provide, respectively, at the working end of the wrench, the actuating arms 6 and 7. Actuating pins 8 and 9 are located, respectively, near the ends of actuating arms 6 and 7. Lateral jaw members 12 and 14 each comprise a pair of spaced and paired identical jaw elements 12*a*, 12*b* and 14*a*, 4*b* joined by a pair of drive pins 16, 17 and 21, 22. As shown in the FIGURES, each drive pin is shown as a double cylindrical pin, but a single drive pin of generally elliptical cross-section could be used as well. The actuating pins 8 and 9 pass through and are joined to lateral jaw members 12 and 14. The upper and lower slotted jaw members, 23 and 27, are sandwiched between the spaced lateral jaw elements of jaw members 12 and 14 with drive pins 16, 17 and 21, 22 passing through slots 24, 25 and 28, 29, respectively. As indicated, there are two slots in each of the upper and lower jaw members 23 and 27 with the slots generally at an angle of 100° from each other with the apex of the angle at the upper end of the upper jaw 23 and at the lower end of the lower jaw 27.

In operation, the handle members 1 and 2 are squeezed together compressing spring 5 and moving actuating arms 6 and 7 and actuating pins 8 and 9 toward each other. The actuating pins 8 and 9 move lateral jaws 12 and 14 toward each other while drive pins 16, 17 and 21, 22 follow cam slots 24, 25 and 28, 29 to move upper and lower jaws 23 and 27 toward each other. With all jaws moving toward a central position, a hexagonal open space 30 is defined between the jaws which decreases in size as handle members 1 and 2 are squeezed together. The wrench will thus lock down on any hexagonal nut or bolt in its size range positioned within space 30. Upon release of squeeze pressure, the spring 5 will return the wrench to normal open position.

The jaw members 12 and 14 are designated "lateral" in the following sense: The vertical axis "A" of the wrench passes between handle members 1 and 2, through pivot 4 and through a hexagonal open space 30 defined between the actuating arms 6 and 7 by cooperating jaw members 12, 14, and 23, 27. The actuating pins 8 and 9 on the actuating arms 6 and 7 are movable toward each other and axis "A" to close upon the hexagonal open space 30. The actuating pins drive the jaw members 12 and 14 laterally toward each other and the vertical axis "A", thereby defining in part the hexagonal open space.

There has thus been described a relatively simple adjustable wrench which is a usefull and effective tool over a wide range of hexagonal nuts and bolts. The manufacture of this wrench is greatly simplified by the fact that the jaw elements 12*a*, 12*b* and 14*a*, 14*b* forming the lateral members 12 and 14 are identical in shape and size as are the top and bottom jaw members 23 and 27.

The above described embodiments of the invention are illustrative only and modifications thereof may occur to those skilled in the art. Accordingly, this invention is not to be regarded as limited by the embodiments disclosed herein, but is to be limited only as defined by the appended claims.

I claim:

1. A wrench adjustable to define a hexagonal space of variable size comprising, a pair of pivotally connected handle members having actuating arms on the ends thereof movable toward each other, an actuating pin on each actuating arm fixed to at least one lateral jaw member to move said jaw member toward a central position, each lateral jaw member having two contact surfaces conforming to two faces of a hexagonal fastener element, an upper and a lower drive pin fixed to each lateral jaw member, upper and lower jaw members each having a pair of cam slots therein arranged at an angle to each other, said upper drive pins slidable in said cam slots of said upper jaw member and said lower drive pins slidable in said cam slots of said lower jaw member to drive said upper and lower jaw members toward a central position as said lateral jaw members are driven toward a central position by said actuating pins to define said central hexagonal space upon handle actuation.

2. The wrench of claim 1 wherein each upper and lower jaw member has a fastener contact surface which conforms to one face of a hexagonal fastener member.

3. The wrench of claim 2 wherein each pair of cam slots is arranged at an angle with the apex of said angle remote from said fastener contact surface.

4. The wrench of claim 3 wherein said angle between said pair of cam slots in each jaw member is approximately 100°.

5. The wrench of claim 4 wherein said pivoted handles are spring-biased to an open position and upon handle actuation the lateral jaws, the upper and lower jaws each contact a peripheral portion of the fastener to surround the fastener.

* * * * *